US012398663B2

(12) United States Patent
Bak et al.

(10) Patent No.: US 12,398,663 B2
(45) **Date of Patent: *Aug. 26, 2025**

(54) GAS TURBINE PLANT WITH AMMONIA DECOMPOSITION SYSTEM

(71) Applicant: DOOSAN ENERBILITY CO., LTD., Changwon-si (KR)

(72) Inventors: Byoung Gu Bak, Suwon-si (KR); Jin Il Kim, Changwon-si (KR); Tae Woo Kim, Yongin-si (KR); Hong Geun Ha, Yongin-si (KR); Young Hoon Bae, Changwon-si (KR); Chil Yeong Seon, Yongin-si (KR); Ki Hyun Lee, Daegu (KR); Kwang Hun Jeong, Gimhae-si (KR)

(73) Assignee: Doosan Enerbility Co., Ltd., Changwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/677,558

(22) Filed: May 29, 2024

(65) Prior Publication Data

US 2024/0401503 A1 Dec. 5, 2024

(30) Foreign Application Priority Data

May 30, 2023 (KR) ..... 10-2023-0069375

(51) Int. Cl.

| | |
|---|---|
| ***F01K 23/10*** | (2006.01) |
| ***F01K 11/02*** | (2006.01) |
| ***F01K 21/04*** | (2006.01) |

(52) U.S. Cl.
CPC ..... *F01K 23/10* (2013.01); *F01K 11/02* (2013.01); *F01K 21/047* (2013.01)

(58) Field of Classification Search
CPC ..... F01K 11/02; F01K 21/047; F01K 23/10; Y02E 20/16; C01B 3/047; C01B 3/04; C01C 1/12
See application file for complete search history.

(56) References Cited

U.S. PATENT DOCUMENTS

| | | | | |
|---|---|---|---|---|
| 5,852,925 | A | 12/1998 | Prasad et al. | |
| 11,156,168 | B2 * | 10/2021 | Nose | F02C 3/20 |
| 11,679,977 | B2 * | 6/2023 | Al-Huwaider | F01K 7/16 60/39.182 |
| 11,912,574 | B1 | 2/2024 | Jo | |
| 11,939,915 | B2 * | 3/2024 | Uechi | F01K 25/103 |
| 2007/0214766 | A1 | 9/2007 | Obana | |

(Continued)

FOREIGN PATENT DOCUMENTS

| | | | |
|---|---|---|---|
| CN | 119222016 | A | 12/2024 |
| JP | 2948351 | A | 9/1999 |

(Continued)

*Primary Examiner* — Jesse S Bogue
(74) *Attorney, Agent, or Firm* — Shook, Hardy & Bacon L.L.P.

(57) ABSTRACT

The present disclosure relates to a gas turbine plant which decomposes ammonia and supplies it as fuel to a combustor of the gas turbine. The gas turbine plant supplies sufficient heat to the ammonia in order to thermally decompose the ammonia effectively, and separates the residual ammonia present in the decomposition gas and supplies it to a combustor of the gas turbine.

12 Claims, 10 Drawing Sheets

(56) References Cited

U.S. PATENT DOCUMENTS

| | | | | |
|---|---|---|---|---|
| 2009/0133400 | A1* | 5/2009 | Callas | F02C 7/143 60/730 |
| 2018/0355794 | A1 | 12/2018 | Bulat | |
| 2019/0084831 | A1 | 3/2019 | Andersen | |
| 2019/0107048 | A1 | 4/2019 | Bulat | |
| 2020/0032676 | A1 | 1/2020 | Nose | |
| 2021/0332759 | A1 | 10/2021 | Smith | |
| 2022/0099021 | A1 | 3/2022 | Uechi | |
| 2022/0154646 | A1 | 5/2022 | Araki | |
| 2022/0162989 | A1 | 5/2022 | Cocks | |
| 2022/0162999 | A1 | 5/2022 | Cocks | |
| 2022/0299205 | A1 | 9/2022 | MacDonald | |
| 2023/0129294 | A1 | 4/2023 | Cocks | |
| 2023/0313735 | A1 | 10/2023 | Smith | |
| 2023/0407784 | A1 | 12/2023 | Takeishi | |
| 2024/0019124 | A1 | 1/2024 | Ito | |
| 2024/0068416 | A1 | 2/2024 | Hagita | |
| 2024/0093639 | A1 | 3/2024 | Ikeda | |
| 2024/0117763 | A1 | 4/2024 | Ito | |
| 2024/0166505 | A1* | 5/2024 | White | B01J 8/0005 |
| 2024/0167417 | A1* | 5/2024 | Lin | F02C 3/22 |
| 2024/0183310 | A1 | 6/2024 | Uechi | |
| 2024/0328358 | A1 | 10/2024 | Barth | |
| 2024/0401519 | A1* | 12/2024 | Bak | C01C 1/12 |
| 2024/0401520 | A1* | 12/2024 | Bak | F02C 3/22 |
| 2024/0401524 | A1* | 12/2024 | Bak | F02C 6/18 |

FOREIGN PATENT DOCUMENTS

| | | | |
|---|---|---|---|
| JP | 2015021499 | A | 2/2015 |
| JP | 2016085189 | A | 5/2016 |
| JP | 2018076794 | A | 5/2018 |
| JP | 2020147478 | A | 9/2020 |
| JP | 2020148183 | A | 9/2020 |
| JP | 20210096274 | A | 8/2021 |
| KR | 20130071099 | A | 6/2013 |
| KR | 20140001773 | A | 1/2014 |
| KR | 20210121192 | A | 10/2021 |
| KR | 20220141943 | A | 10/2022 |
| KR | 20230060372 | A | 5/2023 |
| WO | 2023162600 | A1 | 8/2023 |
| WO | 2024100987 | A1 | 5/2024 |

* cited by examiner

GAS TURBINE PLANT WITH AMMONIA DECOMPOSITION SYSTEM

CROSS-REFERENCE TO RELATED APPLICATIONS

The present application claims priority to Korea Patent Application No. 10-2023-0069375, filed May 30, 2023, the entire contents of which is incorporated herein for all purposes by this reference.

FIELD

The present disclosure relates to a gas turbine plant with an ammonia decomposition system and more particularly to a gas turbine plant which decomposes ammonia and supplies it as fuel to a combustor of the gas turbine.

BACKGROUND

For the purpose of reducing the emission amount of carbon dioxide in order to preserve global environment, it is a promising option to use hydrogen as a fuel which does not emit carbon dioxide even when combusted. However, compared to a fuel such as liquefied natural gas which is widely used as a fuel for a gas turbine, hydrogen is not easy to transport or store. Therefore, it is being considered that ammonia that can be converted to hydrogen is used as a fuel.

Japanese Patent No. 2948351 discloses a gas turbine plant equipped with a decomposition device that heats ammonia and decomposes it into hydrogen and nitrogen. The decomposition device of the gas turbine plant heats ammonia by performing heat exchange between liquid ammonia with pressure increased by a pressure pump and exhaust gas discharged from the gas turbine, thereby thermally decomposing the ammonia into decomposition gas containing hydrogen and nitrogen. This decomposition gas is supplied as it is to a combustor of the gas turbine.

However, the liquid ammonia may not be sufficiently heated by the exhaust gas. In this case, a large amount of ammonia in addition to hydrogen and nitrogen often remains in the decomposition gas. When the decomposition gas is supplied to the combustor of the gas turbine and the residual ammonia is combusted, there is a problem that a large amount of nitrogen oxides (NOx) is generated.

SUMMARY

The purpose of the present disclosure is to provide a gas turbine plant that decomposes ammonia and supplies it as fuel to a combustor of a gas turbine. The gas turbine plant supplies sufficient heat to the ammonia in order to thermally decompose the ammonia effectively, and separates the residual ammonia present in the decomposition gas and supplies it to a combustor of the gas turbine.

The technical problem to be overcome in this document is not limited to the above-mentioned technical problems. Other technical problems not mentioned can be clearly understood from those described below by a person having ordinary skill in the art.

One embodiment is a gas turbine plant with an ammonia decomposition system. The gas turbine plant includes: a storage tank configured to store liquid ammonia; a supply pump configured to supply the liquid ammonia of the storage tank; a preheater configured to preheat the liquid ammonia supplied by the supply pump; a vaporizer configured to vaporize the liquid ammonia preheated by the preheater; a superheater configured to superheat gaseous ammonia vaporized by the vaporizer; a decomposition reactor configured to thermally decompose the gaseous ammonia superheated by the superheater; a separator configured to separate residual ammonia from decomposition gas decomposed by the decomposition reactor; and a second combustor configured to generate combustion gas in such a way as to supply heat to the decomposition reactor. Synthesis gas consisting of hydrogen and nitrogen with the residual ammonia removed by the separator is supplied to a first combustor of a gas turbine. A heat transfer fluid absorbs heat from the combustion gas or the decomposition gas and supplies the heat to the liquid ammonia, the gaseous ammonia, the synthesis gas supplied to the first combustor, or fuel supplied to the second combustor.

A heat transfer fluid circuit through which the heat transfer fluid flows may include: a pump; a first heat exchanger that absorbs heat by heat exchange with the combustion gas or the decomposition gas; and a second heat exchanger that supplies heat by heat exchange with the liquid ammonia, the gaseous ammonia, the synthesis gas supplied to the first combustor, or fuel supplied to the second combustor.

The second heat exchanger may be any one of the preheater, the vaporizer, and the superheater.

The second heat exchanger may be disposed such that the synthesis gas supplied from the separator to the first combustor passes through the second heat exchanger.

The second heat exchanger may be disposed such that the fuel supplied to the second combustor passes through the second heat exchanger.

A portion of the decomposition gas decomposed by the decomposition reactor or a portion of the synthesis gas from which the residual ammonia has been removed in the separator may be supplied as fuel for the second combustor.

A portion of the synthesis gas from which the residual ammonia has been removed in the separator may be supplied as fuel for the second combustor. The second heat exchanger may be disposed such that the synthesis gas from the separator passes through the second heat exchanger before being branched.

Exhaust gas discharged from the gas turbine may be supplied to the heat recovery steam generator. Steam generated by heat of the exhaust gas in the heat recovery steam generator may be supplied to a steam turbine and may drive the steam turbine, and then may flow into a condenser, and water condensed in the condenser may be supplied back to the heat recovery steam generator. A portion of the water condensed in the condenser may be supplied as the heat transfer fluid to the heat transfer fluid circuit.

The heat transfer fluid circuit may further include an internal heat exchanger in which the water discharged from the condenser and the water entering the condenser exchange heat.

The water discharged from the condenser may absorb heat while passing through the internal heat exchanger, may absorb heat while passing through the first heat exchanger, and then may supply the heat while passing through the second heat exchanger, and may supply the heat while passing through the internal heat exchanger, and then may flow back into the condenser.

The combustion gas may supply heat while passing through the decomposition reactor and the superheater. The heat transfer fluid may absorb heat from the combustion gas that has passed through the decomposition reactor and the superheater.

Another embodiment is a gas turbine plant with an ammonia decomposition system. The gas turbine plant includes: a storage tank configured to store liquid ammonia; a supply pump configured to supply the liquid ammonia of the storage tank; a preheater configured to preheat the liquid ammonia supplied by the supply pump; a vaporizer configured to vaporize the liquid ammonia preheated by the preheater; a superheater configured to superheat gaseous ammonia vaporized by the vaporizer; a decomposition reactor configured to thermally decompose the gaseous ammonia superheated by the superheater; and a separator configured to separate residual ammonia from decomposition gas decomposed by the decomposition reactor. Synthesis gas consisting of hydrogen and nitrogen with the residual ammonia removed by the separator is supplied to a first combustor of a gas turbine. A heat transfer fluid absorbs heat from the decomposition gas and supplies the heat to the liquid ammonia, the gaseous ammonia, or the synthesis gas supplied to the first combustor.

A heat transfer fluid circuit through which the heat transfer fluid flows may include: a pump; a first heat exchanger that absorbs heat by heat exchange with the decomposition gas; and a second heat exchanger that supplies heat by heat exchange with the liquid ammonia, the gaseous ammonia, or the synthesis gas supplied to the first combustor.

The second heat exchanger may be any one of the preheater, the vaporizer, and the superheater.

The second heat exchanger may be disposed such that the synthesis gas supplied from the separator to the first combustor passes through the second heat exchanger.

Exhaust gas discharged from the gas turbine may be supplied to the heat recovery steam generator. Steam generated by heat of the exhaust gas in the heat recovery steam generator may be supplied to a steam turbine and drives the steam turbine, and then may flow into a condenser, and water condensed in the condenser may be supplied back to the heat recovery steam generator. A portion of the water condensed in the condenser may be supplied as the heat transfer fluid to the heat transfer fluid circuit.

The heat transfer fluid circuit may further include an internal heat exchanger in which the water discharged from the condenser and the water entering the condenser exchange heat.

The water discharged from the condenser may absorb heat while passing through the internal heat exchanger, may absorb heat while passing through the first heat exchanger, and then may supply the heat while passing through the second heat exchanger, and may supply the heat while passing through the internal heat exchanger, and then may flow back into the condenser.

According to the embodiment, as the ammonia decomposition system includes the preheater, the vaporizer, and the superheater, which are for heating the ammonia before the decomposition reactor, sufficient heat can be supplied to the ammonia. Also, when the combustion gas generated by a separate second combustor supplies heat to the decomposition reactor, the ammonia can be thermally decomposed effectively at a high temperature.

Also, ammonia or fuel supplied to the combustor is heated by using the combustion gas or the decomposition gas generated within the plant, so that the efficiency of the plant can be improved. Here, when the fuel (synthesis gas, etc.) entering the combustor is heated, the amount of fuel used for target temperature of the combustion gas can be reduced.

Also, a portion of the ammonia, the decomposition gas, or the synthesis gas present in the ammonia decomposition system is supplied as fuel to the second combustor, so that a separate fuel such as fossil fuel, etc., is not required.

The effect of the present disclosure is not limited to the above effects and should be construed as including all the effects that can be inferred from the configuration of the present disclosure disclosed in the detailed description or claims of the present disclosure.

DETAILED DESCRIPTION

Figure 1:
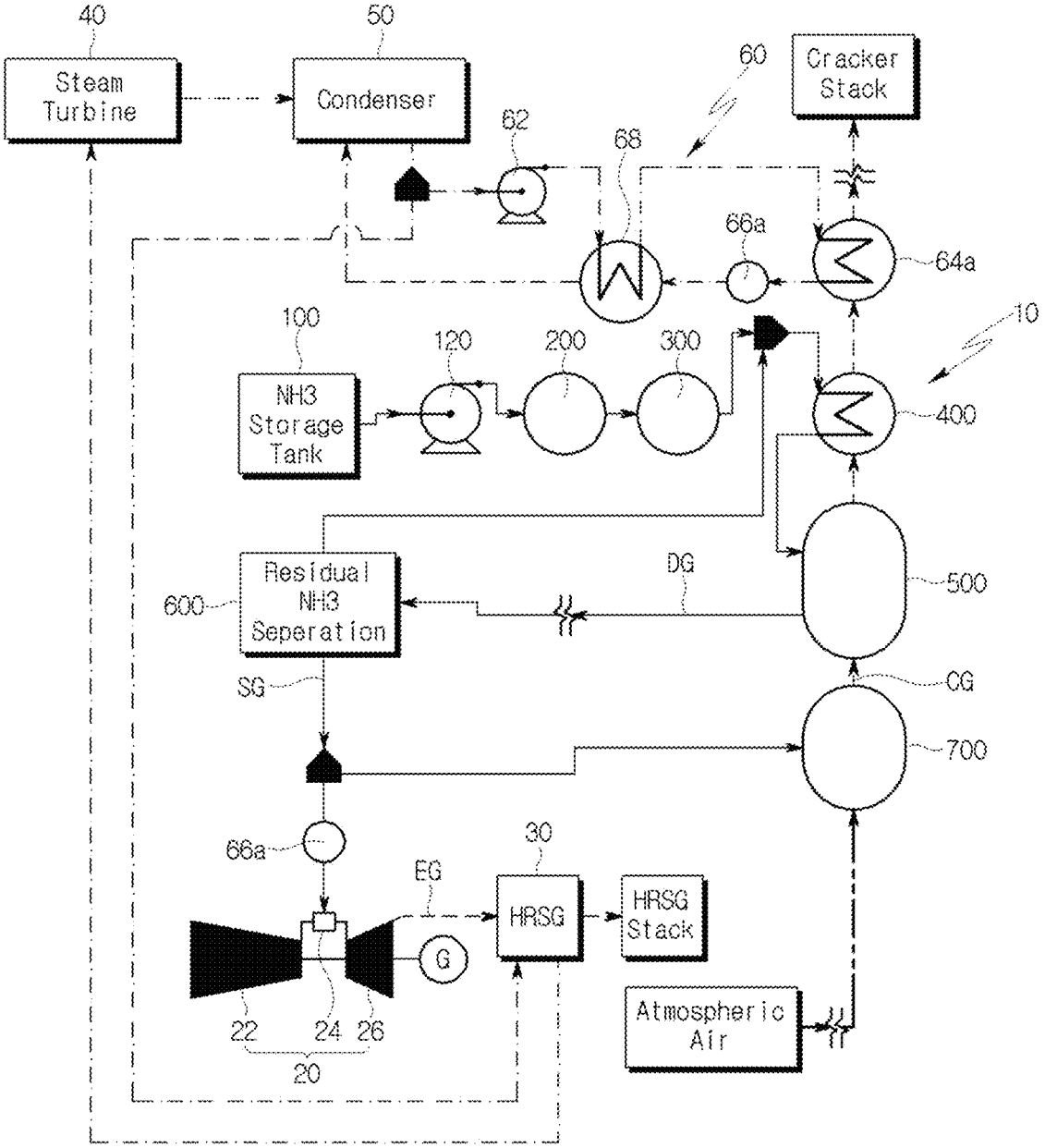
FIG. 1 is a schematic diagram of a gas turbine plant with an ammonia decomposition system according to an embodiment.

Hereinafter, preferable embodiments of a gas turbine plant with an ammonia decomposition system will be described with reference to accompanying drawings.

Also, the below-mentioned terms are defined in consideration of the functions in the present disclosure and may be changed according to the intention of users or operators or custom. The following embodiments do not limit the scope of the present disclosure and are merely exemplary of the components presented in the claims of the present disclosure.

Parts irrelevant to the description will be omitted for a clear description of the present disclosure. The same or similar reference numerals will be assigned to the same or similar components throughout this specification. Throughout this specification, when it is mentioned that a portion "includes" an element, it means that the portion does not exclude but further includes other elements unless there is a special opposite mention.

First, a gas turbine plant including an ammonia decomposition system according to an embodiment of the present disclosure will be described with reference to FIG. 1.

The gas turbine plant according to the embodiment generally includes an ammonia decomposition system 10, a gas turbine 20, a heat recovery steam generator (HRSG) 30, a steam turbine 40, a condenser 50, and a heat transfer fluid circuit 60.

The ammonia decomposition system 10 includes a storage tank 100, a supply pump 120, a preheater 200, a vaporizer 300, a superheater 400, a decomposition reactor 500, a separator 600, and a second combustor 700.

The gas turbine 20 includes a compressor 22 for compressing air to high pressure, a first combustor 24 for mixing the air compressed by the compressor 22 with fuel and for combusting, and a turbine 26 for generating power while rotating turbine blades by using high-temperature and high-pressure combustion gas discharged from the first combustor 24.

In the embodiment of the present disclosure, synthesis gas based on hydrogen decomposed in the ammonia decomposition system 10 as a main component is supplied as fuel for the first combustor 24. It is shown in the drawing that only the synthesis gas is supplied. However, in some cases, it is also possible that the synthesis gas and natural gas are supplied to the first combustor 24 together and mixed and combusted.

Exhaust gas (EG) discharged from the turbine 26 of the gas turbine 20 is supplied to the heat recovery steam generator 30 and vaporizes water into steam within the heat recovery steam generator 30. The steam generated by heat of the exhaust gas (EG) in the heat recovery steam generator 30 is supplied to the steam turbine 40 and drives the steam turbine to produce electric power. After driving the steam turbine 40, the steam flows into the condenser 50 and is condensed by cooling water, and the water condensed in the condenser 50 is supplied back to the heat recovery steam generator 30.

Hereinafter, each component of the ammonia decomposition system 10 will be described in detail. FIG. 1 shows a flow of ammonia or ammonia-decomposed gas passing through the components of the ammonia decomposition system 10, and adjacent components will be connected to each other through connection pipes, etc.

The storage tank 100 stores liquid ammonia, and the supply pump 120 increases the pressure of the liquid ammonia of the storage tank 100 and supplies the liquid ammonia to the preheater 200.

Subsequently, the preheater 200, the vaporizer 300, and the superheater 400 are configured to vaporize and heat the liquid ammonia prior to the decomposition reactor 500. Specifically, the preheater 200 preheats the liquid ammonia supplied by the supply pump 120. The vaporizer 300 vaporizes the liquid ammonia preheated by the preheater 200. The superheater 400 superheats the gaseous ammonia vaporized by the vaporizer 300.

As one example, when the supply pump 120 increases the pressure of the liquid ammonia to 40 atm, a boiling point of the ammonia at 40 atm is around 100° C. In this case, the preheater 200 heats the liquid ammonia to below the boiling point, and the vaporizer 300 heats the liquid ammonia to the boiling point and generates gaseous ammonia. The superheater 400 additionally heats the gaseous ammonia.

The decomposition reactor 500 thermally decomposes the gaseous ammonia superheated by the superheater 400 and generates decomposition gas (DG) containing hydrogen, nitrogen, and residual ammonia. A catalyst that promotes the thermal decomposition of the ammonia may be filled in the decomposition reactor 500. The catalyst has a catalyst component that activates a decomposition reaction, and a carrier that supports the catalyst component. An example of the catalyst component includes particles of precious metal such as Ru, etc., and metal particles including transition metals such as Ni, Co, and Fe, etc. The carrier includes a metal oxide such as $Al_2O_3$, $ZrO_2$, $Pr_2O_3$, $La_2O_3$, MgO, etc. The catalyst is not limited to the catalysts exemplified above as long as the catalyst activates the decomposition reaction of ammonia.

The separator 600 separates residual ammonia from the decomposition gas (DG) decomposed in the decomposition reactor 500. Then, the residual ammonia is removed in the separator 600, the synthesis gas (SG) consisting of hydrogen and nitrogen is supplied to the first combustor 24 of the gas turbine. Here, the residual ammonia separated by the separator 600 may be mixed with the gaseous ammonia vaporized by the vaporizer 300 and may be supplied to the superheater 400. Since ammonia is highly soluble in water, the separator 600 can remove the residual ammonia by dissolving the residual ammonia in water. Also, ammonia is easier to evaporate than water. Therefore, when ammonia water that is obtained by dissolving the residual ammonia in water is heated, gaseous ammonia can be separated again.

Here, a reaction temperature for the thermal decomposition of the ammonia (depending on the catalyst, generally 400° C. to 700° C.) is much higher than a boiling point of ammonia. Therefore, the superheater 400 and the decomposition reactor 500 requires a higher temperature heat source than the preheater 200 and the vaporizer 300.

To this end, the ammonia decomposition system 10 includes the second combustor 700 that generates combustion gas (CG) such that heat is supplied to the decomposition reactor 500. In the embodiment, the combustion gas (CG) generated by the second combustor 700 supplies heat while passing through the decomposition reactor 500 and the superheater 400. However, the embodiment is not limited to this, and the combustion gas (CG) may additionally pass through the preheater 200 or the vaporizer 300.

The combustion gas (CG) generated from the second combustor 700 generally has a temperature of about 1000° C., which is higher than that of the exhaust gas (EG) discharged from the gas turbine 20. Therefore, by using the combustion gas (CG) with the inclusion of the separate second combustor 700, the ammonia can be effectively thermally decomposed by the decomposition reactor 500 even without using a high-performance catalyst, and the efficiency of the decomposition reactor 500 can be improved.

However, according to the embodiment, when the separate second combustor 700 is not included, at least a portion of the exhaust gas (EG) discharged from the gas turbine 20 may supply heat while passing through the decomposition reactor 500 and the superheater 400. In this case, the exhaust gas (EG) discharged from the gas turbine 20 is branched and a portion of the exhaust gas (EG) may be supplied to the decomposition reactor 500, and the other portion may be supplied to the heat recovery steam generator 30. Alternatively, the exhaust gas (EG) discharged from the gas turbine 20 may supply heat while passing through the decomposition reactor 500 and the superheater 400 in turn, and then may be supplied to the heat recovery steam generator 30.

As such, the ammonia decomposition system 10 may include the preheater 200, the vaporizer 300, and the superheater 400, which are for heating the ammonia before the decomposition reactor 500, and the exhaust gas (EG) or the combustion gas (CG) generated by the separate second combustor 700 supplies heat to the decomposition reactor 500. Accordingly, sufficient heat can be supplied to the ammonia and the ammonia can be thermally decomposed effectively.

Accordingly, there is not much residual ammonia in the decomposition gas (DG), and the residual ammonia is reliably removed through the separator 600 and the decomposition gas (DG) is supplied to the first combustor 24, thereby reducing nitrogen oxides in the exhaust gas (EG).

Next, the heat transfer fluid circuit 60 will be described in detail.

In the embodiment of the present invention, a heat transfer fluid absorbs heat from the combustion gas (CG) or the decomposition gas (DG) and supplies the heat to the liquid ammonia, the gaseous ammonia, the synthesis gas supplied to the first combustor 24, or fuel supplied to the second combustor 700. In this way, ammonia or fuel supplied to the combustor is heated by using the combustion gas (CG) or the decomposition gas (DG) generated within the plant, so that the efficiency of the plant can be improved.

In FIG. 1, the description will be made based on the fact that the heat transfer fluid absorbs heat from the combustion gas (CG) and supplies the heat to the synthesis gas (SG) supplied to the first combustor 24.

Specifically, the heat transfer fluid circuit 60 through which the heat transfer fluid flows includes a pump 62, a first heat exchanger 64*a* that absorbs heat by heat exchange with the combustion gas (CG), and a second heat exchanger 66*a* that supplies heat by heat exchange with the synthesis gas (SG) supplied to the first combustor 24. That is, in the first heat exchanger 64*a*, direct heat exchange occurs between the heat transfer fluid and the combustion gas (CG), so that the heat may be transferred from the combustion gas (CG) to the heat transfer fluid. In the second heat exchanger 66*a*, direct heat exchange occurs between the heat transfer fluid and the synthesis gas (SG), so that the heat may be transferred from the heat transfer fluid to the synthesis gas (SG). In this case, the second heat exchanger 66*a* serves as a fuel heater that heats the fuel (synthesis gas) entering the first combustor 24, which results in the reduction of the amount of fuel used for target temperature of the combustion gas in the first combustor 24. In FIG. 1, the two second heat exchangers 66*a* disposed on the heat transfer fluid circuit and on the path of the synthesis gas (SG) are the same components and are shown separately for the simplification of the drawing.

The first heat exchanger 64*a* may be disposed downstream of the superheater 400 such that the combustion gas (CG) that has passed through the decomposition reactor 500 and the superheater 400 can pass through the first heat exchanger 64*a*. Also, the second heat exchanger 66*a* may be disposed on the path of the synthesis gas (SG) such that the synthesis gas (SG) supplied from the separator 600 to the first combustor 24 can pass through the second heat exchanger 66*a*. In particular, in the embodiment, a portion of the synthesis gas (SG) from which the residual ammonia has been removed in the separator 600 is supplied as fuel for the second combustor 700, and accordingly, the synthesis gas (SG) from the separator 600 is branched and then supplied to the first combustor 24 and the second combustor 700, respectively. In this case, the second heat exchanger 66*a* may be disposed on a path through which the synthesis gas (SG) is branched and then supplied to the first combustor 24, in order to heat the fuel supplied to the first combustor 24.

Here, a separate fluid (for example, antifreeze) unrelated to the plant may be supplied as the heat transfer fluid. However, in the embodiment, a portion of the water condensed in the condenser 50 is supplied as a heat transfer fluid to the heat transfer fluid circuit 60.

While the temperature of the water discharged after being condensed in the condenser 50 is generally about 15° C., the temperature of the water discharged from the second heat exchanger 66*a* and entering the condenser 50 is still high, so that there is a burden of having to significantly lower the temperature in the condenser 50. To this end, the heat transfer fluid circuit 60 may further include an internal heat exchanger 68 in which the water discharged from the condenser 50 and the water entering the condenser 50 exchange heat. That is, as shown in FIG. 1, the water discharged from the condenser 50 may absorb heat while passing through the internal heat exchanger 68, may absorb heat while passing through the first heat exchanger 64*a*, and then may supply the heat while passing through the second heat exchanger 66*a*, and may supply heat while passing through the internal heat exchanger 68. Then, the water may flow back into the condenser 50. According to this, the water discharged from the second heat exchanger 66*a* can transfer heat to the water entering the first heat exchanger 64*a*, thereby reducing the burden on the condenser 50 and improving efficiency.

The following embodiments will focus on differences from the embodiment shown in FIG. 1.

Figure 2:
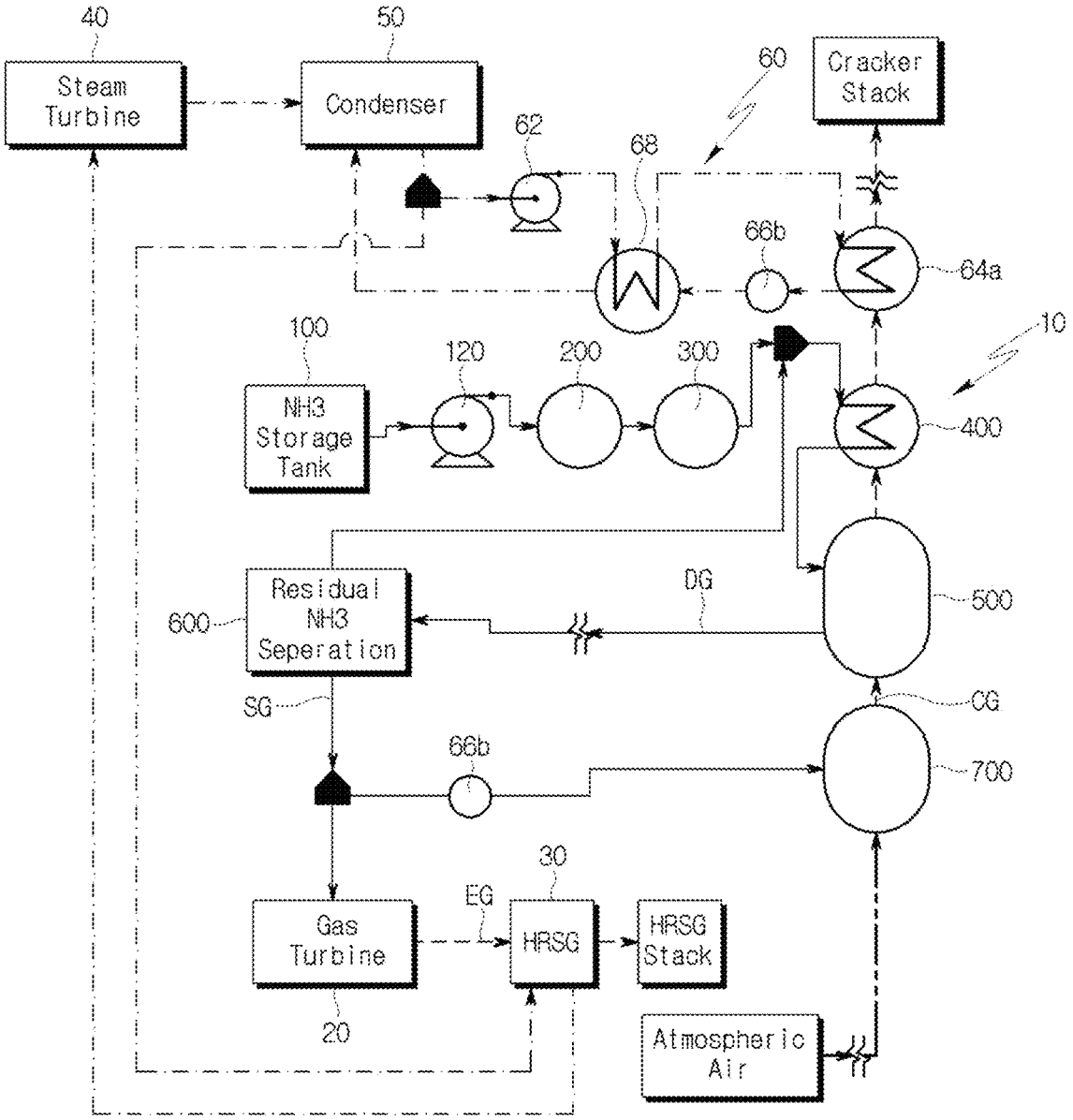
FIG. 2 is a schematic diagram of a gas turbine plan with an ammonia decomposition system according to an embodiment.

According to the embodiment shown in FIG. 2, the gas turbine plant includes the heat transfer fluid circuit 60, and the heat transfer fluid absorbs heat from the combustion gas (CG) and supplies the heat to the fuel supplied to the second combustor 700. In the embodiment, a portion of the synthesis gas (SG) from which residual ammonia has been removed in the separator 600 is supplied as fuel for the second combustor 700, so that the fuel supplied to the second combustor 700 corresponds to the synthesis gas (SG).

Specifically, the heat transfer fluid circuit 60 through which the heat transfer fluid flows includes the pump 62, the first heat exchanger 64*a* that absorbs heat by heat exchange with the combustion gas (CG), and a second heat exchanger 66*b* that supplies heat by heat exchange with the synthesis gas (SG) supplied to the second combustor 700, and the internal heat exchanger 68. That is, in the first heat exchanger 64*a*, direct heat exchange occurs between the heat transfer fluid and the combustion gas (CG), so that the heat may be transferred from the combustion gas (CG) to the heat transfer fluid. In the second heat exchanger 66*b*, direct heat exchange occurs between the heat transfer fluid and the synthesis gas (SG), so that the heat may be transferred from the heat transfer fluid to the synthesis gas (SG). In this case, the second heat exchanger 66*b* serves as a fuel heater that heats the fuel (synthesis gas) entering the second combustor 700, which results in the reduction of the amount of fuel used for target temperature of the combustion gas in the second combustor 700. In FIG. 2, the two second heat exchangers 66*b* disposed on the heat transfer fluid circuit and on the path of the synthesis gas (SG) are the same components and are shown separately for the simplification of the drawing.

The second heat exchanger 66*b* may be disposed on the path of the synthesis gas (SG) such that the synthesis gas (SG) supplied from the separator 600 to the second combustor 700 can pass through the second heat exchanger 66*b*. In particular, in the embodiment, since the synthesis gas (SG) from the separator 600 is branched and then supplied to the first combustor 24 and the second combustor 700, respectively, the second heat exchanger 66*b* may be disposed on the path through which the synthesis gas (SG) is branched and then supplied to the second combustor 700.

Figure 3:
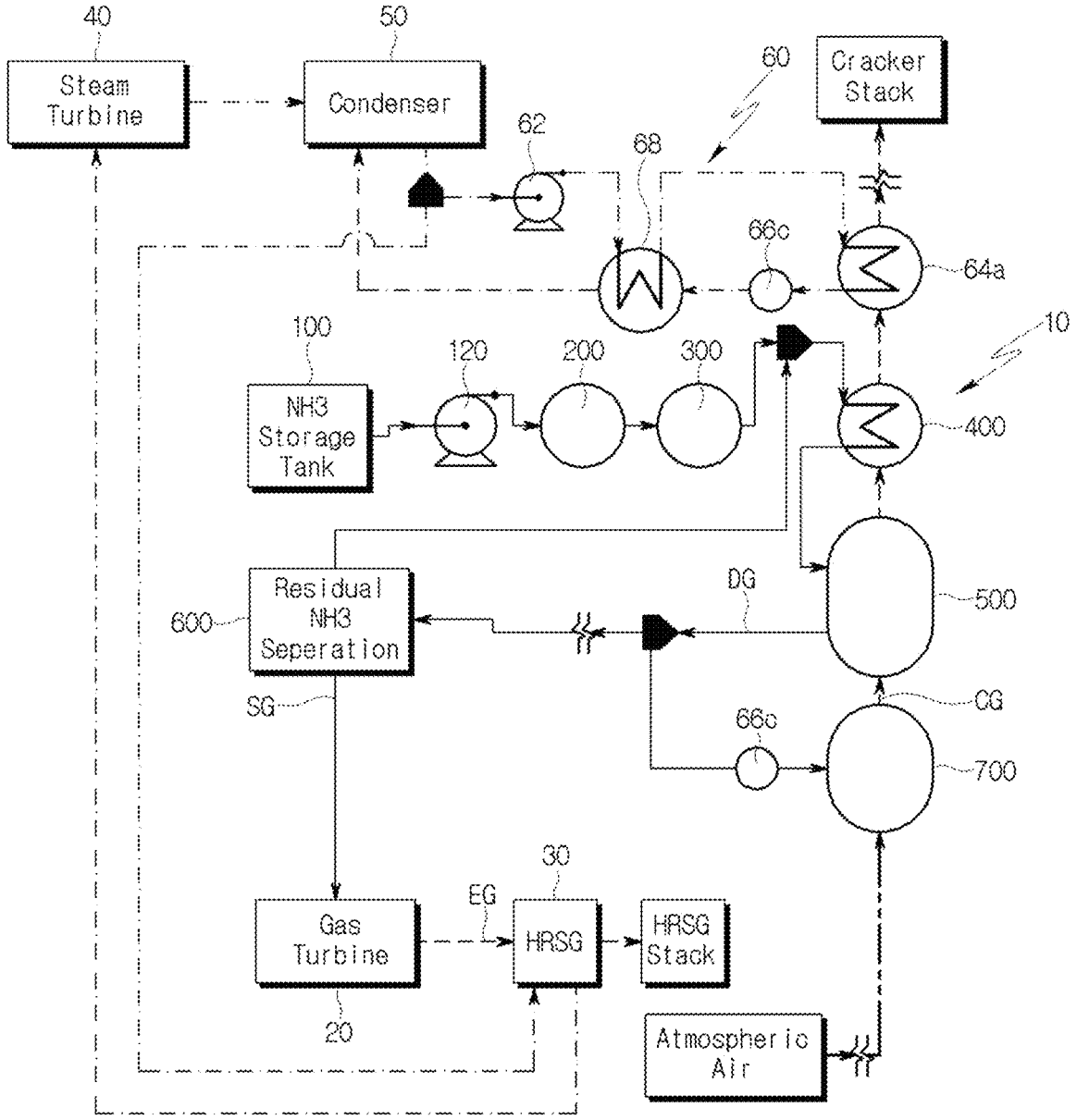
FIG. 3 is a schematic diagram of a gas turbine plan with an ammonia decomposition system according to an embodiment.

According to the embodiment, as shown in FIG. 3, when a portion of the decomposition gas (DG) decomposed in the decomposition reactor 500 is supplied as fuel for the second combustor 700, it is also possible that the second heat exchanger 66*c* may be disposed on the path of the decomposition gas (DG) such that the decomposition gas (DG) supplied from the decomposition reactor 500 to the second combustor 700 can pass the second heat exchanger 66*c*.

Figure 4:
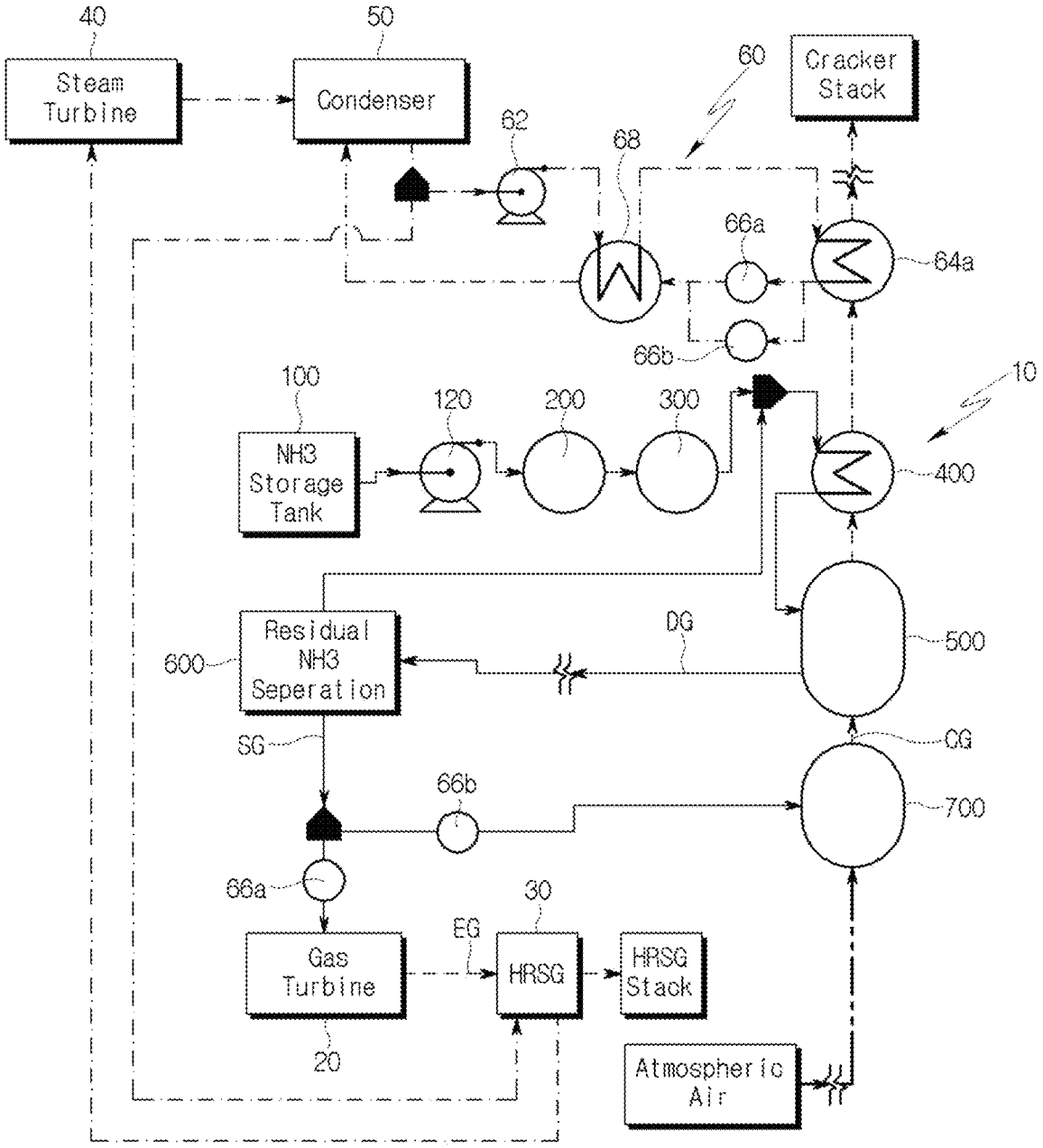
FIG. 4 is a schematic diagram of a gas turbine plan with an ammonia decomposition system according to an embodiment.
Figure 5:
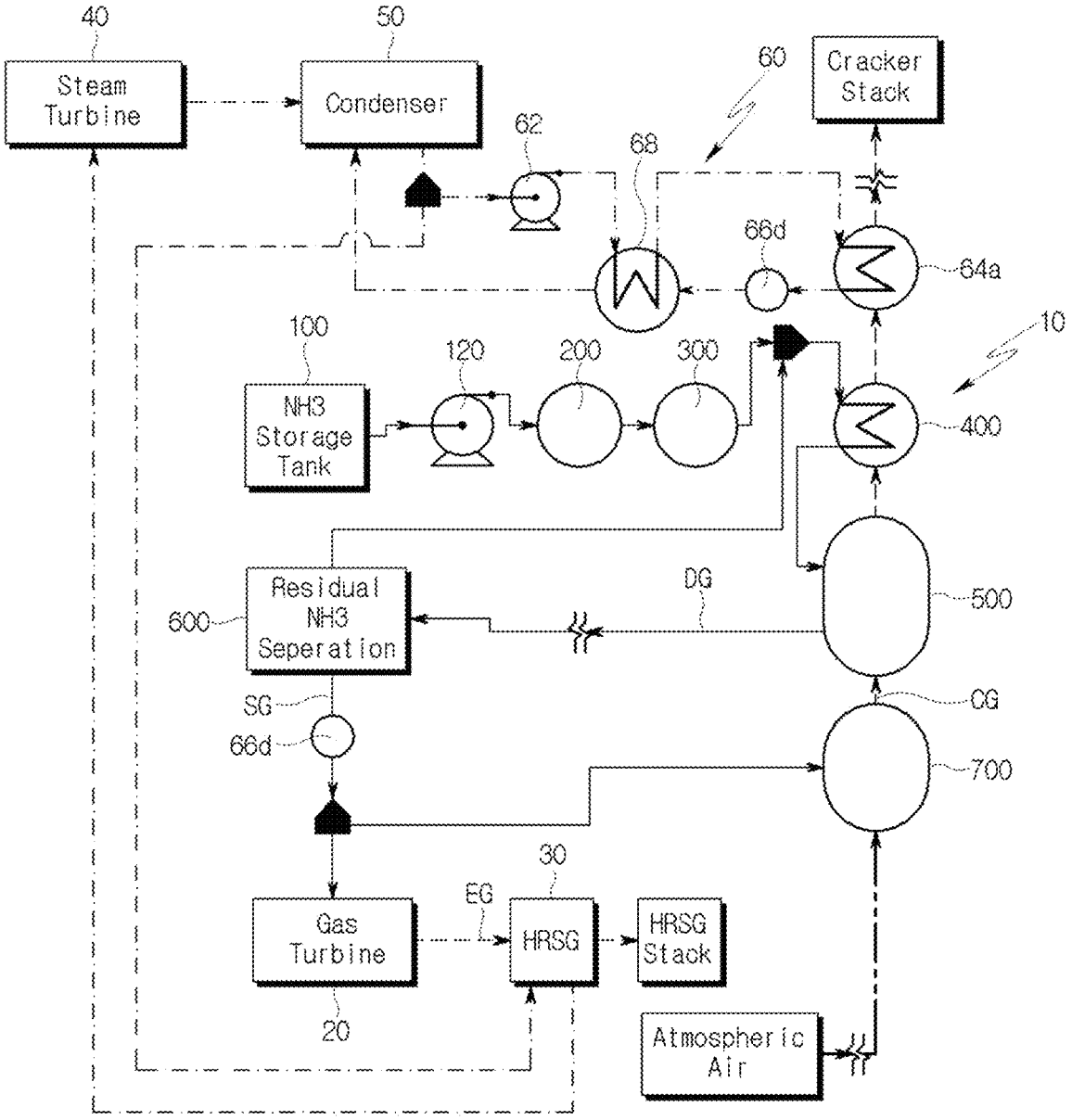
FIG. 5 is a schematic diagram of a gas turbine plan with an ammonia decomposition system according to an embodiment.

Also, according to the embodiments shown in FIGS. 4 and 5, the heat transfer fluid absorbs heat from the combustion gas (CG) and supplies the heat both to the synthesis gas supplied to the first combustor 24 and the fuel supplied to the second combustor 700. In FIGS. 4 and 5, a portion of the synthesis gas (SG) from which residual ammonia has been removed in the separator 600 is supplied as fuel for the second combustor 700, so that the fuel supplied to the second combustor 700 also corresponds also to the synthesis gas (SG).

To this end, in FIG. 4, the heat transfer fluid circuit 60 includes the pump 62, the first heat exchanger 64*a*, the internal heat exchanger 68, and two second heat exchangers 66*a* and 66*b*. Within the heat transfer fluid circuit 60, the two second heat exchangers 66*a* and 66*b* may be arranged in parallel or in series. The synthesis gas (SG) from the separator 600 is branched and then supplied to the first combustor 24 and the second combustor 700, respectively. Also, one second heat exchanger 66*a* may be disposed on the path through which the synthesis gas (SG) is branched and then supplied to the first combustor 24, and the other second heat exchanger 66*b* may be disposed on the path through which the synthesis gas (SG) is branched and then supplied to the second combustor 700. Accordingly, the two second heat exchangers 66*a* and 66*b* serve as fuel heaters that heat the fuel (synthesis gas) entering the first combustor 24 and the second combustor 700, respectively.

Alternatively, in FIG. 5, the heat transfer fluid circuit 60 includes the pump 62, the first heat exchanger 64*a*, the internal heat exchanger 68, and one second heat exchanger 66*d*. The synthesis gas (SG) from the separator 600 is branched and then supplied to the first combustor 24 and the second combustor 700, respectively. The one second heat exchanger 66*d* may be disposed such that the synthesis gas (SG) from the separator 600 passes through the second heat exchanger 66*d* before being branched. Accordingly, the second heat exchanger 66*d* serves as a fuel heater that heats all the fuel (synthesis gas) entering the first combustor 24 and the second combustor 700 before being branched.

Figure 6:
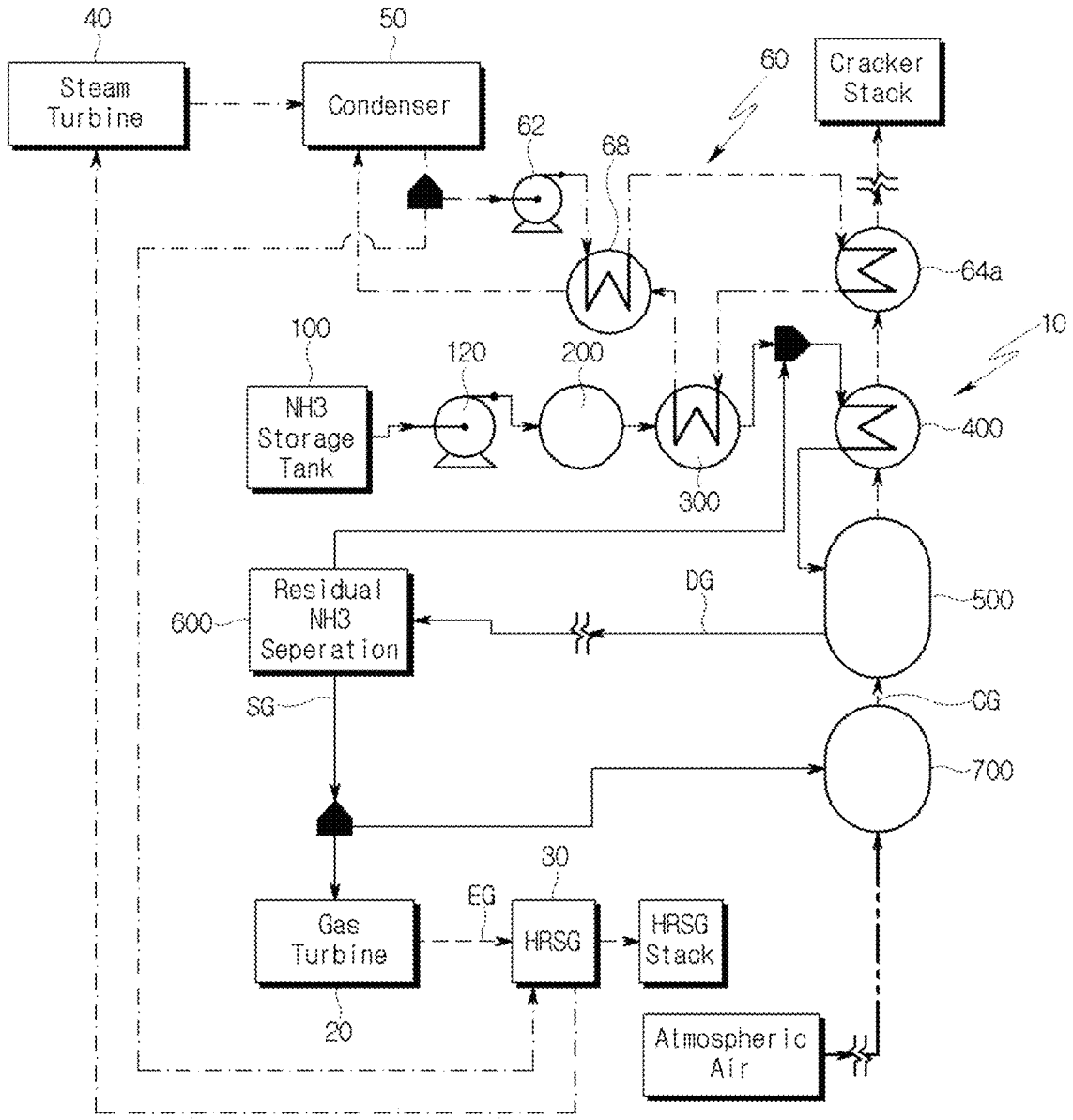
FIG. 6 is a schematic diagram of a gas turbine plan with an ammonia decomposition system according to an embodiment.

Next, according to the embodiment shown in FIG. 6, the gas turbine plant includes the heat transfer fluid circuit 60, and the heat transfer fluid absorbs heat from the combustion gas (CG) and supplies the heat to the liquid ammonia.

Specifically, the heat transfer fluid circuit 60 through which the heat transfer fluid flows includes the pump 62, the first heat exchanger 64*a* that absorbs heat by heat exchange with the combustion gas (CG), and the second heat exchanger that supplies heat by heat exchange with the liquid ammonia, and the internal heat exchanger 68. Here, the second heat exchanger corresponds to the vaporizer 300, and the heat transfer fluid heats the liquid ammonia to the boiling point by supplying heat to the liquid ammonia in the vaporizer 300, so that the liquid ammonia can be vaporized. That is, in the first heat exchanger 64*a*, direct heat exchange occurs between the heat transfer fluid and the combustion gas (CG), so that the heat may be transferred from the combustion gas (CG) to the heat transfer fluid. In the vaporizer 300, direct heat exchange occurs between the heat transfer fluid and the liquid ammonia, so that the heat may be transferred from the heat transfer fluid to the liquid ammonia.

However, the embodiment is not limited to this. The second heat exchanger may correspond to the preheater 200 or the superheater 400, and the heat transfer fluid may also supply heat to the liquid ammonia or the gaseous ammonia.

Figure 7:
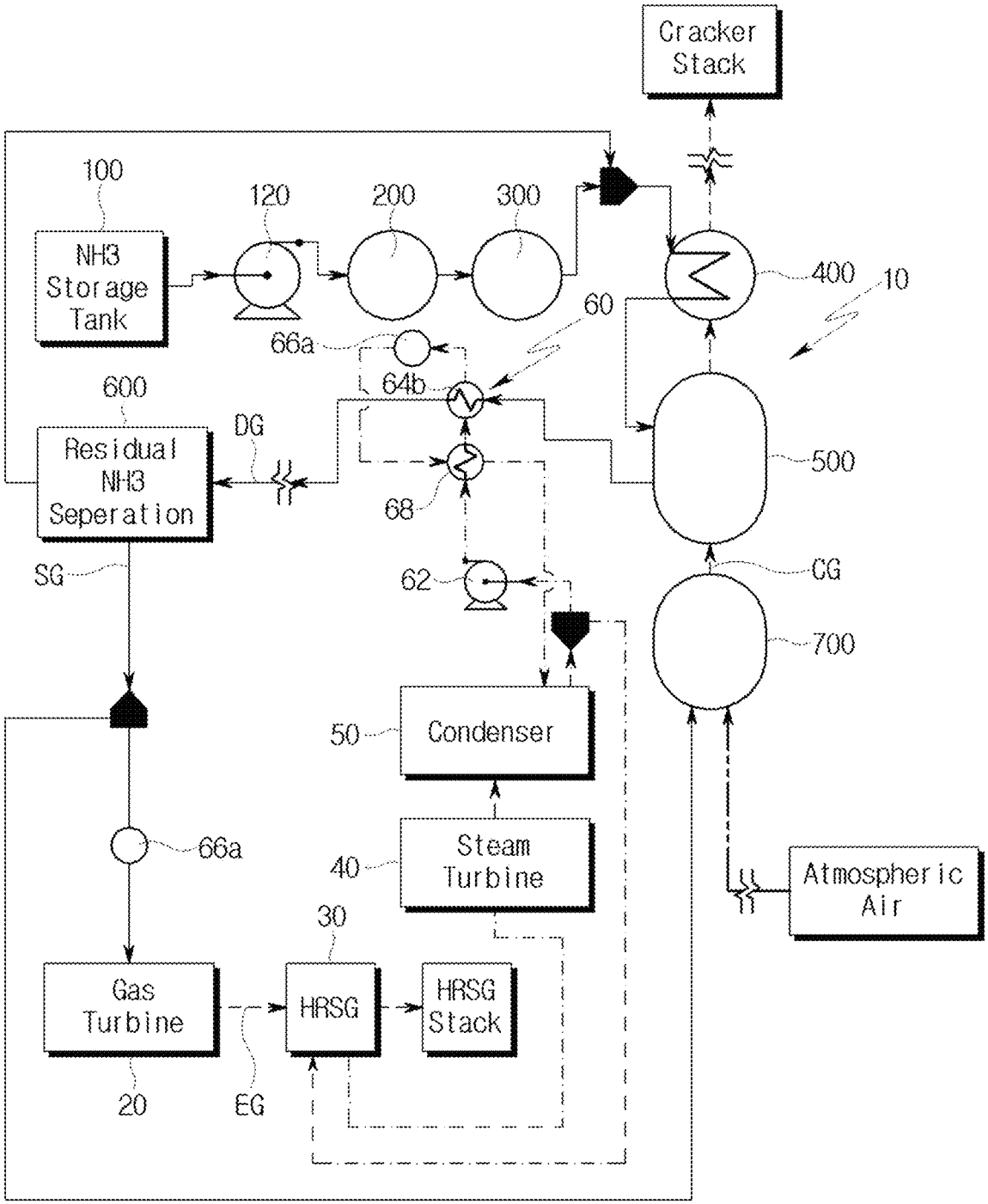
FIG. 7 is a schematic diagram of a gas turbine plan with an ammonia decomposition system according to an embodiment.

Next, according to the embodiment shown in FIG. 7, the gas turbine plant includes the heat transfer fluid circuit 60, and the heat transfer fluid absorbs heat from the decomposition gas (DG) and supplies the heat to the synthesis gas (SG) supplied to the first combustor 24.

Specifically, the heat transfer fluid circuit 60 through which the heat transfer fluid flows includes the pump 62, a first heat exchanger 64*b* that absorbs heat by heat exchange with the decomposition gas (DG), and the second heat exchanger 66*a* that supplies heat by heat exchange with the synthesis gas (SG) supplied to the first combustor 24. That is, in the first heat exchanger 64*b*, direct heat exchange occurs between the heat transfer fluid and the decomposition gas (DG), so that the heat may be transferred from the decomposition gas (DG) to the heat transfer fluid. In the second heat exchanger 66*a*, direct heat exchange occurs between the heat transfer fluid and the synthesis gas (SG), so that the heat may be transferred from the heat transfer fluid to the synthesis gas (SG). The first heat exchanger 64*b* may be disposed downstream of the decomposition reactor 500 such that decomposition gas (DG) from the decomposition reactor 500 can pass through the first heat exchanger 64*b*.

Likewise, a separate fluid (for example, antifreeze) unrelated to the plant may be supplied as the heat transfer fluid. However, in the embodiment, a portion of the water condensed in the condenser 50 is supplied as a heat transfer fluid to the heat transfer fluid circuit 60. Therefore, the heat transfer fluid circuit 60 may further include the internal heat exchanger 68 in which the water discharged from the condenser 50 and the water entering the condenser 50 exchange heat. In the internal heat exchanger 68, the water discharged from the second heat exchanger 66*a* can transfer heat to the water entering the first heat exchanger 64*b*, thereby reducing the burden on the condenser 50 and improving efficiency.

The embodiment shows the second heat exchanger 66*a* for heating the synthesis gas (SG) supplied to the first combustor 24. However, as already described above, the second heat exchanger 66*a* may be replaced by the second heat exchangers 66*b* and 66*c* for heating the fuel supplied to the second combustor 700 or the second heat exchanger 66*d* for simultaneously heating the fuel supplied to the first combustor 24 and the second combustor 700.

Figure 8:
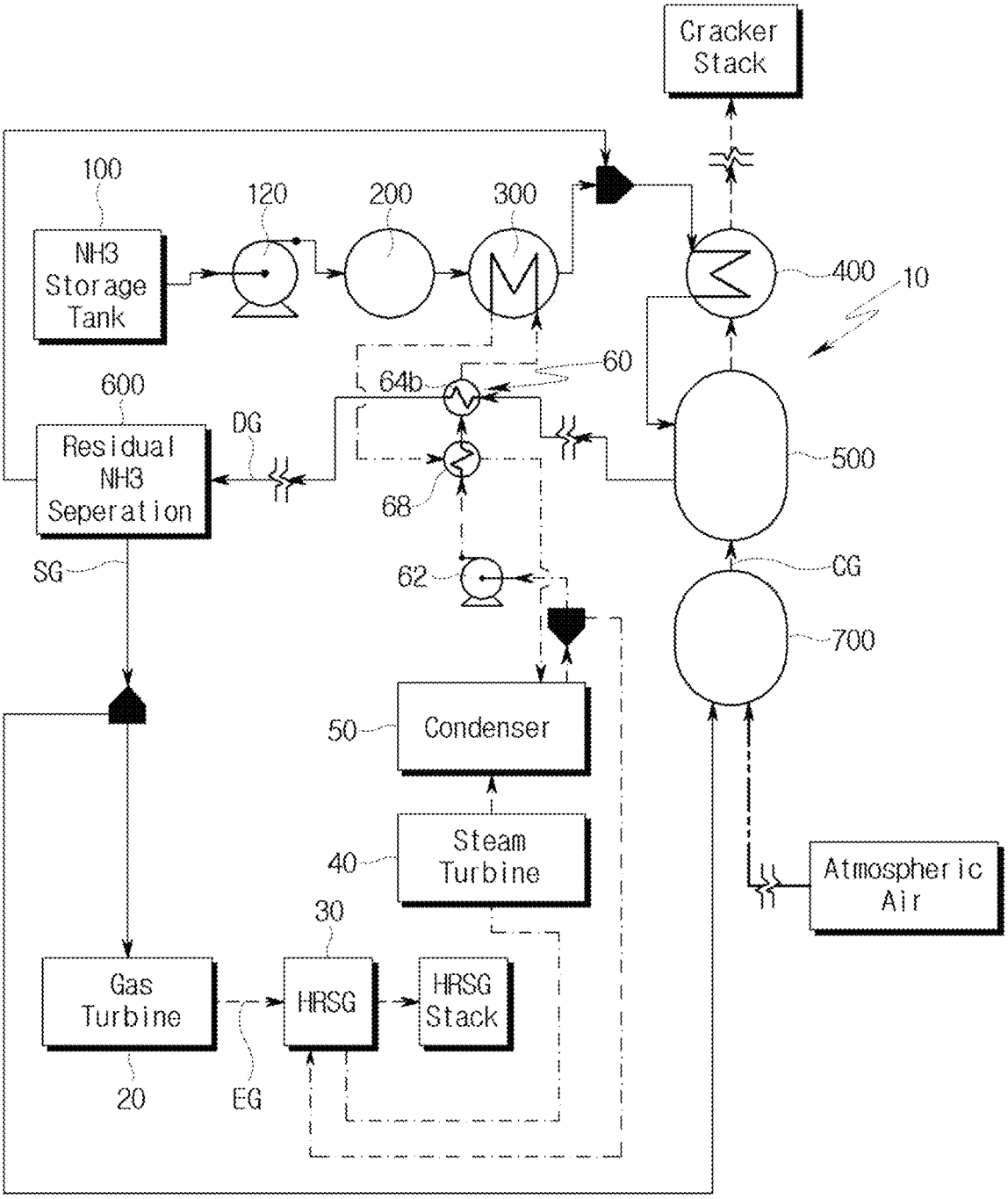
FIG. 8 is a schematic diagram of a gas turbine plan with an ammonia decomposition system according to an embodiment.
Figure 9:
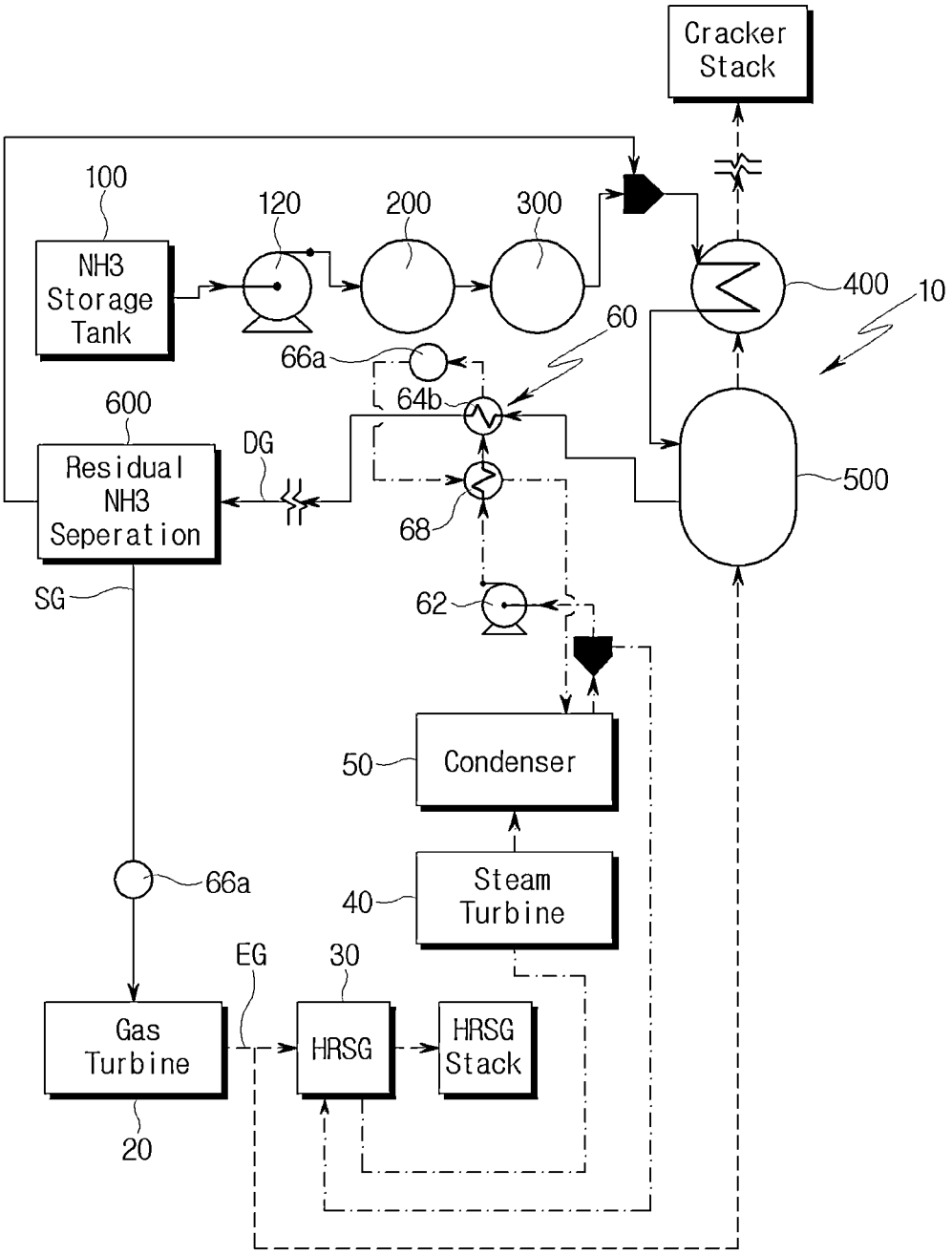
FIG. 9 is a schematic diagram of a gas turbine plan with an ammonia decomposition system according to an embodiment.
Figure 10:
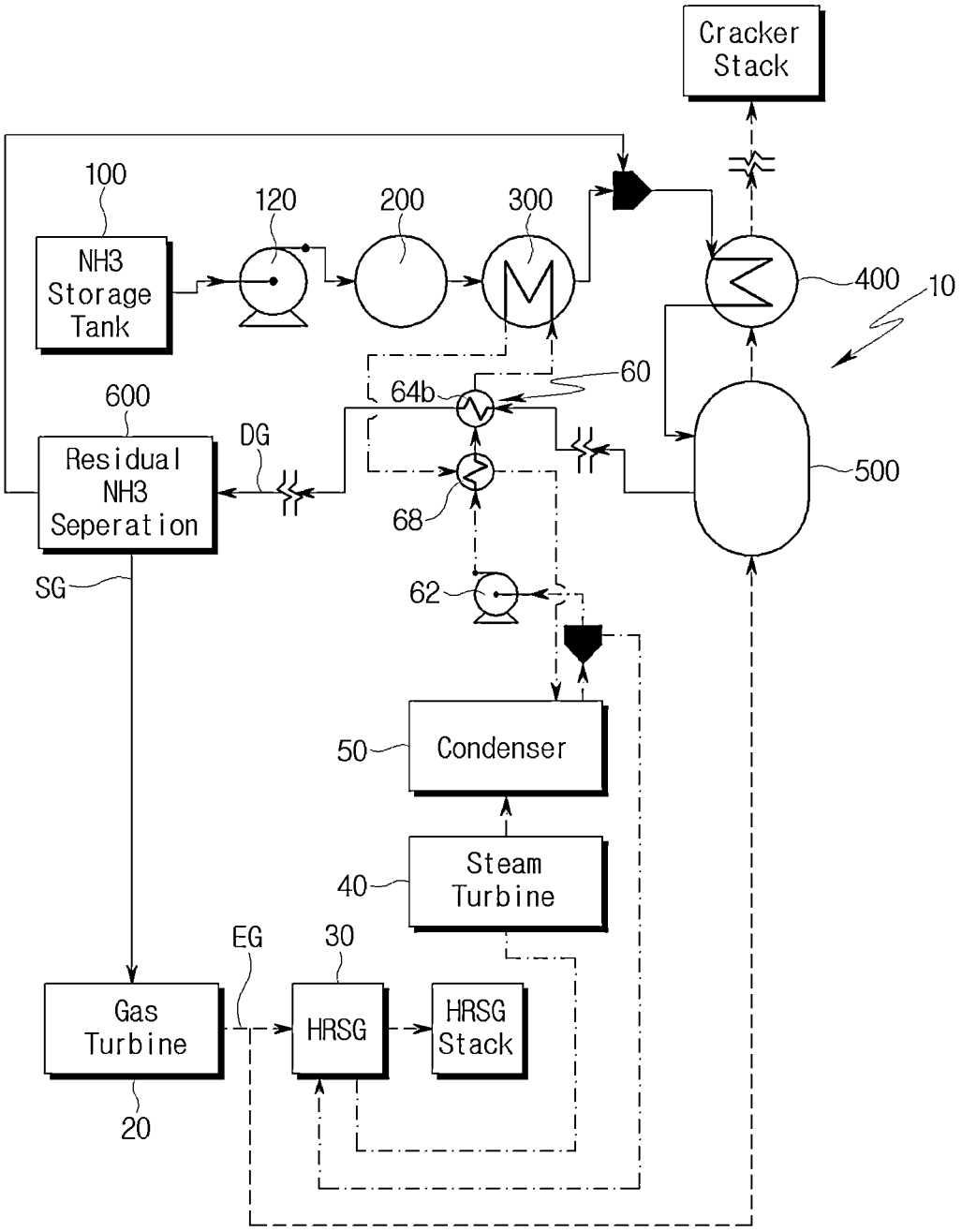
FIG. 10 is a schematic diagram of a gas turbine plan with an ammonia decomposition system according to an embodiment.

Finally, according to the embodiment shown in FIG. 8, the gas turbine plant includes the heat transfer fluid circuit 60, and the heat transfer fluid absorbs heat from the decomposition gas (DG) and supplies heat to the liquid ammonia.

Specifically, the heat transfer fluid circuit 60 through which the heat transfer fluid flows includes the pump 62, the first heat exchanger 64*b* that absorbs heat by heat exchange with the decomposition gas (DG), the second heat exchanger that supplies heat by heat exchange with the liquid ammonia, and the internal heat exchanger 68. Here, the second heat exchanger corresponds to the vaporizer 300, and the heat transfer fluid heats the liquid ammonia to the boiling point by supplying heat to the liquid ammonia in the vaporizer 300, so that the liquid ammonia can be vaporized. That is, in the first heat exchanger 64*b*, direct heat exchange occurs between the heat transfer fluid and the decomposition gas (DG), so that the heat may be transferred from the decomposition gas (DG) to the heat transfer fluid. In the vaporizer 300, direct heat exchange occurs between the heat transfer fluid and the liquid ammonia, so that the heat may be transferred from the heat transfer fluid to the liquid ammonia.

However, the embodiment is not limited to this. The second heat exchanger may correspond to the preheater 200 or the superheater 400, and the heat transfer fluid may also supply heat to the liquid ammonia or the gaseous ammonia.

The present invention is not limited to the described specific embodiments and descriptions described above. Various modifications can be made by anyone skilled in the art without departing from the subject matter of the present invention as defined by the appended claims. Such modifications fall within the scope of protection of the present invention.

REFERENCE NUMERALS

10: Ammonia Decomposition System
20: Gas Turbine
22: Compressor
24: First Combustor
26: Turbine
30: Heat Recovery Steam Generator
40: Steam Turbine
50: Condenser
60: Heat Transfer Fluid Circuit
62: Pump
64*a*, 64*b*: First Heat Exchanger
66*a*, 66*b*, 66*c*, 66*d*: Second Heat Exchanger
68: Internal Heat Exchanger
100: Storage Tank
120: Supply Pump
200: Preheater
300: Vaporizer
400: Superheater
500: Decomposition Reactor
600: Separator
700: Second Combustor
EG: Exhaust Gas
DG: Decomposition Gas
SG: Synthesis Gas
CG: Combustion Gas

What is claimed is:

1. A gas turbine plant with an ammonia decomposition system, the gas turbine plant comprising:
a storage tank configured to store liquid ammonia;
a supply pump configured to supply the liquid ammonia of the storage tank;
a preheater configured to preheat the liquid ammonia supplied by the supply pump;
a vaporizer configured to vaporize the liquid ammonia preheated by the preheater;
a superheater configured to superheat gaseous ammonia vaporized by the vaporizer;
a decomposition reactor configured to thermally decompose the gaseous ammonia superheated by the superheater;
a separator configured to separate residual ammonia from decomposition gas decomposed by the decomposition reactor; and
a second combustor configured to generate combustion gas in such a way as to supply heat to the decomposition reactor,
wherein synthesis gas consisting of hydrogen and nitrogen with the residual ammonia removed by the separator is supplied to a first combustor of a gas turbine,
wherein a heat transfer fluid absorbs heat from the combustion gas or the decomposition gas and supplies the heat to the liquid ammonia, the gaseous ammonia, the synthesis gas supplied to the first combustor, or fuel supplied to the second combustor;
wherein a heat transfer fluid circuit through which the heat transfer fluid flows comprises:
a pump;
a first heat exchanger that absorbs heat by heat exchange with the combustion gas or the decomposition gas; and
a second heat exchanger that supplies heat by heat exchange with the liquid ammonia, the gaseous ammonia, the synthesis gas supplied to the first combustor, or fuel supplied to the second combustor;
wherein exhaust gas discharged from the gas turbine is supplied to a heat recovery steam generator,
wherein steam generated by heat of the exhaust gas in the heat recovery steam generator is supplied to a steam turbine and drives the steam turbine, and then flows into a condenser, and water condensed in the condenser is supplied back to the heat recovery steam generator,
wherein a portion of the water condensed in the condenser is supplied as the heat transfer fluid to the heat transfer fluid circuit, and
wherein the heat transfer fluid circuit further comprises an internal heat exchanger in which the water discharged from the condenser and the water entering the condenser exchange heat.

2. The gas turbine plant with an ammonia decomposition system of claim 1, wherein the second heat exchanger is any one of the preheater, the vaporizer, and the superheater.

3. The gas turbine plant with an ammonia decomposition system of claim 1, wherein the second heat exchanger is disposed such that the synthesis gas supplied from the separator to the first combustor passes through the second heat exchanger.

4. The gas turbine plant with an ammonia decomposition system of claim 1, wherein the second heat exchanger is disposed such that the fuel supplied to the second combustor passes through the second heat exchanger.

5. The gas turbine plant with an ammonia decomposition system of claim 4, wherein a portion of the decomposition gas decomposed by the decomposition reactor or a portion of the synthesis gas from which the residual ammonia has been removed in the separator is supplied as fuel for the second combustor.

6. The gas turbine plant with an ammonia decomposition system of claim 1,
wherein a portion of the synthesis gas from which the residual ammonia has been removed in the separator is supplied as fuel for the second combustor, and
wherein the second heat exchanger is disposed such that the synthesis gas from the separator passes through the second heat exchanger before being branched.

7. The gas turbine plant with an ammonia decomposition system of claim 1, wherein the water discharged from the condenser absorbs heat while passing through the internal heat exchanger, absorbs heat while passing through the first heat exchanger, and then supplies the heat while passing through the second heat exchanger, and supplies the heat while passing through the internal heat exchanger, and then flows back into the condenser.

8. The gas turbine plant with an ammonia decomposition system of claim 1,
wherein the combustion gas supplies heat while passing through the decomposition reactor and the superheater, and wherein the heat transfer fluid absorbs heat from the combustion gas that has passed through the decomposition reactor and the superheater.

9. A gas turbine plant with an ammonia decomposition system, the gas turbine plant comprising:

a storage tank configured to store liquid ammonia;

a supply pump configured to supply the liquid ammonia of the storage tank;

a preheater configured to preheat the liquid ammonia supplied by the supply pump;

a vaporizer configured to vaporize the liquid ammonia preheated by the preheater;

a superheater configured to superheat gaseous ammonia vaporized by the vaporizer;

a decomposition reactor configured to thermally decompose the gaseous ammonia superheated by the superheater; and a separator configured to separate residual ammonia from decomposition gas decomposed by the decomposition reactor, wherein synthesis gas consisting of hydrogen and nitrogen with the residual ammonia removed by the separator is supplied to a first combustor of a gas turbine, wherein a heat transfer fluid absorbs heat from the decomposition gas and supplies the heat to the liquid ammonia, the gaseous ammonia, or the synthesis gas supplied to the first combustor, wherein a heat transfer fluid circuit through which the heat transfer fluid flows comprises:

a pump;

a first heat exchanger that absorbs heat by heat exchange with the decomposition gas; and a second heat exchanger that supplies heat by heat exchange with the liquid ammonia, the gaseous ammonia, or the synthesis gas supplied to the first combustor;

wherein exhaust gas discharged from the gas turbine is supplied to a heat recovery steam generator, wherein steam generated by heat of the exhaust gas in the heat recovery steam generator is supplied to a steam turbine and drives the steam turbine, and then flows into a condenser, and water condensed in the condenser is supplied back to the heat recovery steam generator, wherein a portion of the water condensed in the condenser is supplied as the heat transfer fluid to the heat transfer fluid circuit; and wherein the heat transfer fluid circuit further comprises an internal heat exchanger in which the water discharged from the condenser and the water entering the condenser exchange heat.

10. The gas turbine plant with an ammonia decomposition system of claim 9, wherein the second heat exchanger is any one of the preheater, the vaporizer, and the superheater.

11. The gas turbine plant with an ammonia decomposition system of claim 9, wherein the second heat exchanger is disposed such that the synthesis gas supplied from the separator to the first combustor passes through the second heat exchanger.

12. The gas turbine plant with an ammonia decomposition system of claim 9, wherein the water discharged from the condenser absorbs heat while passing through the internal heat exchanger, absorbs heat while passing through the first heat exchanger, and then supplies the heat while passing through the second heat exchanger, and supplies the heat while passing through the internal heat exchanger, and then flows back into the condenser.

* * * * *